US007108638B2

(12) United States Patent
Snyderman

(10) Patent No.: US 7,108,638 B2
(45) Date of Patent: Sep. 19, 2006

(54) EXERCISE DEVICE

(76) Inventor: Leonard Snyderman, 132 Myrtle St., #1, Boston, MA (US) 02114

( * ) Notice: Subject to any disclaimer, the term of this patent is extended or adjusted under 35 U.S.C. 154(b) by 317 days.

(21) Appl. No.: 10/868,398

(22) Filed: Jun. 15, 2004

(65) Prior Publication Data

US 2005/0277517 A1 Dec. 15, 2005

(51) Int. Cl.
*A63B 69/18* (2006.01)
*A63B 22/00* (2006.01)

(52) U.S. Cl. ..... 482/57; 482/51; 482/52

(58) Field of Classification Search ..... 482/51–53, 482/57, 70, 79–80, 71; 601/27, 33–35
See application file for complete search history.

(56) References Cited

U.S. PATENT DOCUMENTS 2,081,365 A * 5/1937 Mueller et al. ..... 601/30
4,396,189 A * 8/1983 Jenkins ..... 482/71
4,786,050 A * 11/1988 Geschwender ..... 482/57
5,267,922 A * 12/1993 Robinson ..... 482/53
5,403,255 A * 4/1995 Johnston ..... 482/57
5,536,225 A * 7/1996 Neuberg et al. ..... 482/71
5,569,127 A * 10/1996 Johnston ..... 482/52
5,830,111 A * 11/1998 Johnston ..... 482/52
5,902,216 A * 5/1999 Lee ..... 482/57
6,679,813 B1 * 1/2004 Gray ..... 482/71

* cited by examiner

*Primary Examiner*—Stephen R. Crow
(74) *Attorney, Agent, or Firm*—William Nitkin

(57) ABSTRACT

An exercise device having dual pedals wherein each pedal operates in a rotary manner in a vertical plane parallel to the bilateral axis of the user with each of the user's feet disposed, respectively, on a different one of the dual pedals.

7 Claims, 6 Drawing Sheets

EXERCISE DEVICE

BACKGROUND OF THE INVENTION

1. Field of the Invention

The device of this invention resides in the field of exercise machines and more particularly relates to a leg-exercising device having pedals that is operated by the bilateral pedaling action of a user moving each pedal in a lateral rotary motion.

2. History of the Prior Art

Pedaling structures for leg exercise are well known. They usually consist of bicycle-like structures having pedals arrayed for movement of each leg of the user which leg movements are generally in a plane that is parallel to the vertical dorsal-ventral axis plane of the user such that the user pushes on each pedal in a circular motion, each of which moves in a vertical plane parallel to the vertical dorsal-ventral axis plane of the user.

SUMMARY OF THE INVENTION

It is an object of this invention to provide an exercise device having dual pedals wherein each pedal operates in a rotary manner in a vertical plane parallel to the plane running sideways bilaterally through the user and at 90 degrees to the user's dorsal-ventral axis plane. The movement of each pedal is 180 degrees from the other in a circular movement, e.g. when one pedal is at a 12 o'clock position, the other is at a 6 o'clock position. The user rotates the pedals bilaterally in a vertical plane at 90 degrees to the vertical dorsal-ventral axis plane of a traditional bicycle. Thus, the pedals are moved about an axis in a vertical plane that is parallel to the vertical plane through the sides of the body of the user. This new pedal movement is useful for individuals wishing to exercise particular leg muscles in this fashion. This type of exercise can be especially useful for runners, skaters, skiers and other athletes desiring to exercise particular muscle groups that might not otherwise be strengthened by exercising on traditional exercise bicycles.

The device of this invention encompasses a housing containing the operating mechanism as described further below, for the rotation of a pair of pedal members in a circular movement spaced apart from one another, each pedal member rotating in a vertical plane about an axis wherein each pedal is at 180 degrees to the position of the other pedal member, such pedal action in a plane that is parallel to the bilateral axis plane through the sides of a user. The pedal mechanism is further adapted to maintain each pedal in an upward-facing position at all times, even as the pedal moves through its circular motion; and a flywheel is provided for smooth pedal action. A handle member is provided for support of the user while operating the exercise device of this invention.

DESCRIPTION OF THE PREFERRED EMBODIMENT(S)

Figure 1:
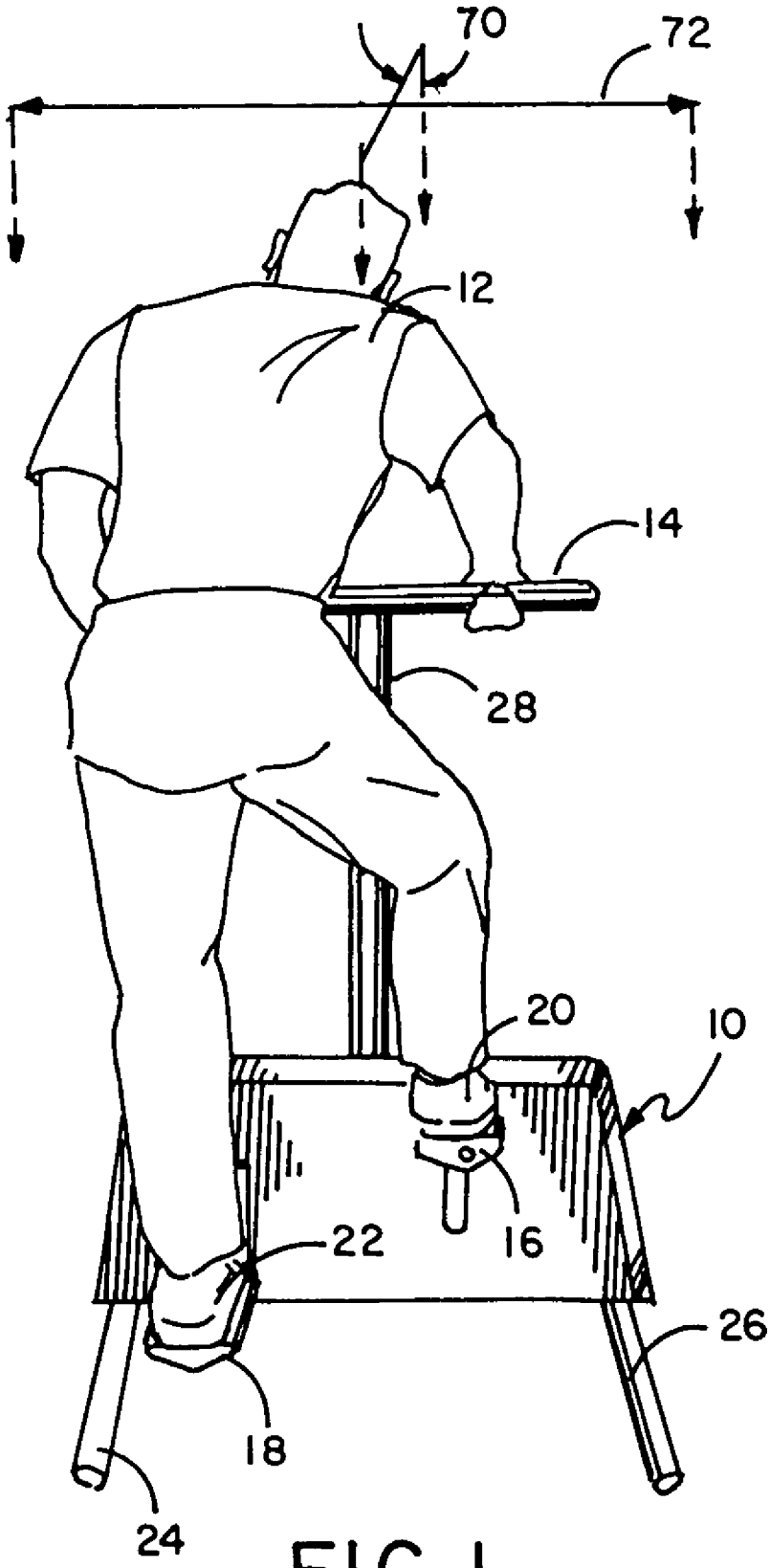
FIG. 1 illustrates a front view of the exercise device of this invention showing the user facing the device.

FIG. 1 illustrates a front view of exercise device 10 of this invention with user 12 positioned thereon facing the device. The dorsal-ventral axis of the user is depicted by line 70; and the bilateral axis, by line 72. As seen in this view the user has placed his right foot 20 onto second pedal 16 and his left foot 22 onto first pedal 18. Device 10 is supported on first support member 24 and second support member 26 and has a handle support member 28 extending up from the device which can support a laterally extending handle 14 which user 12 can hold for support while using the device.

Figure 2:
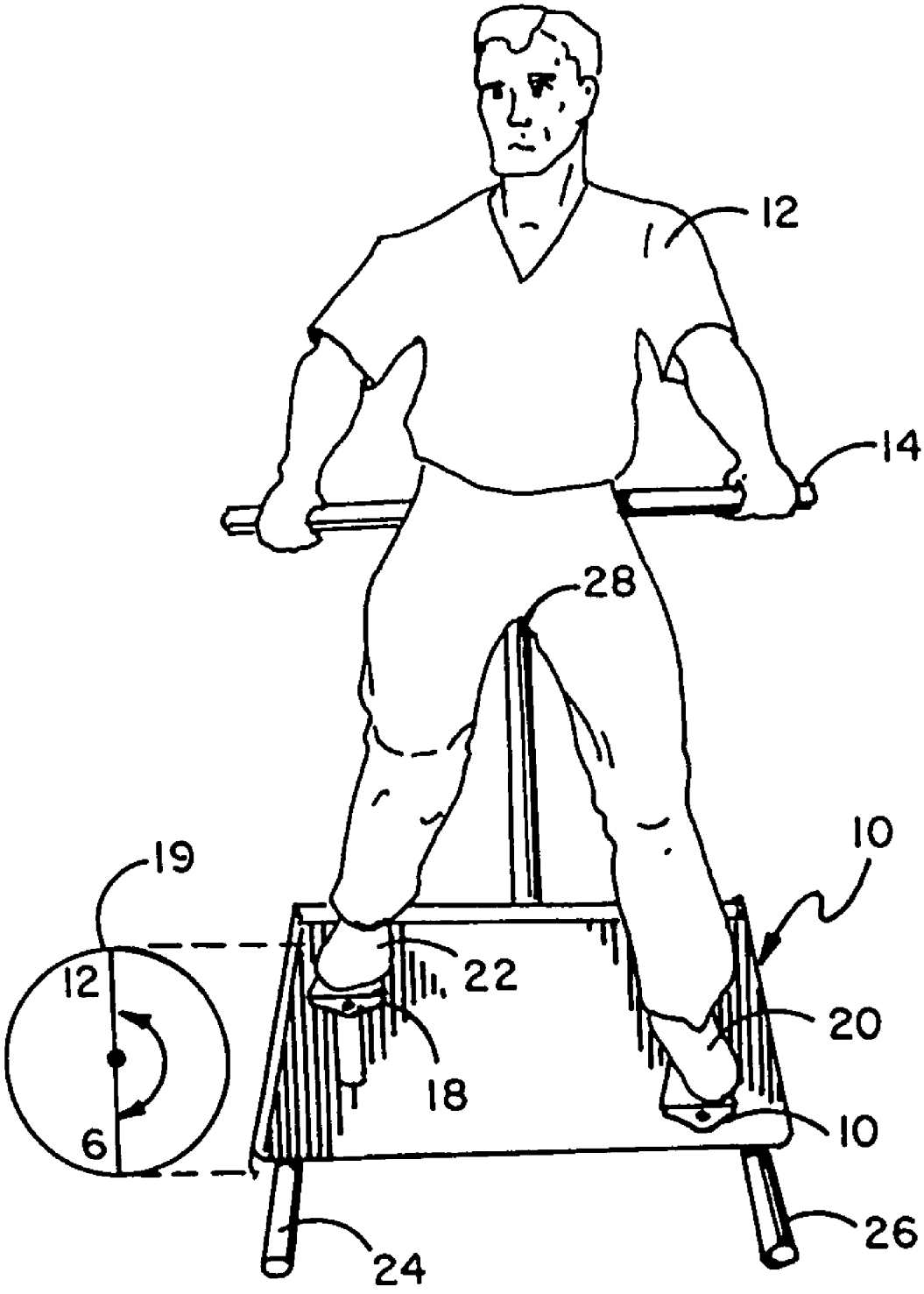
FIG. 2 illustrates a front view of the device of this invention showing the user facing away from the device.

FIG. 2 illustrates user 12 with his back toward the front of the device of this invention and wherein first and second pedals 18 and 16 have been rotated to be in opposite positions to that seen in FIG. 1.

Figure 3:
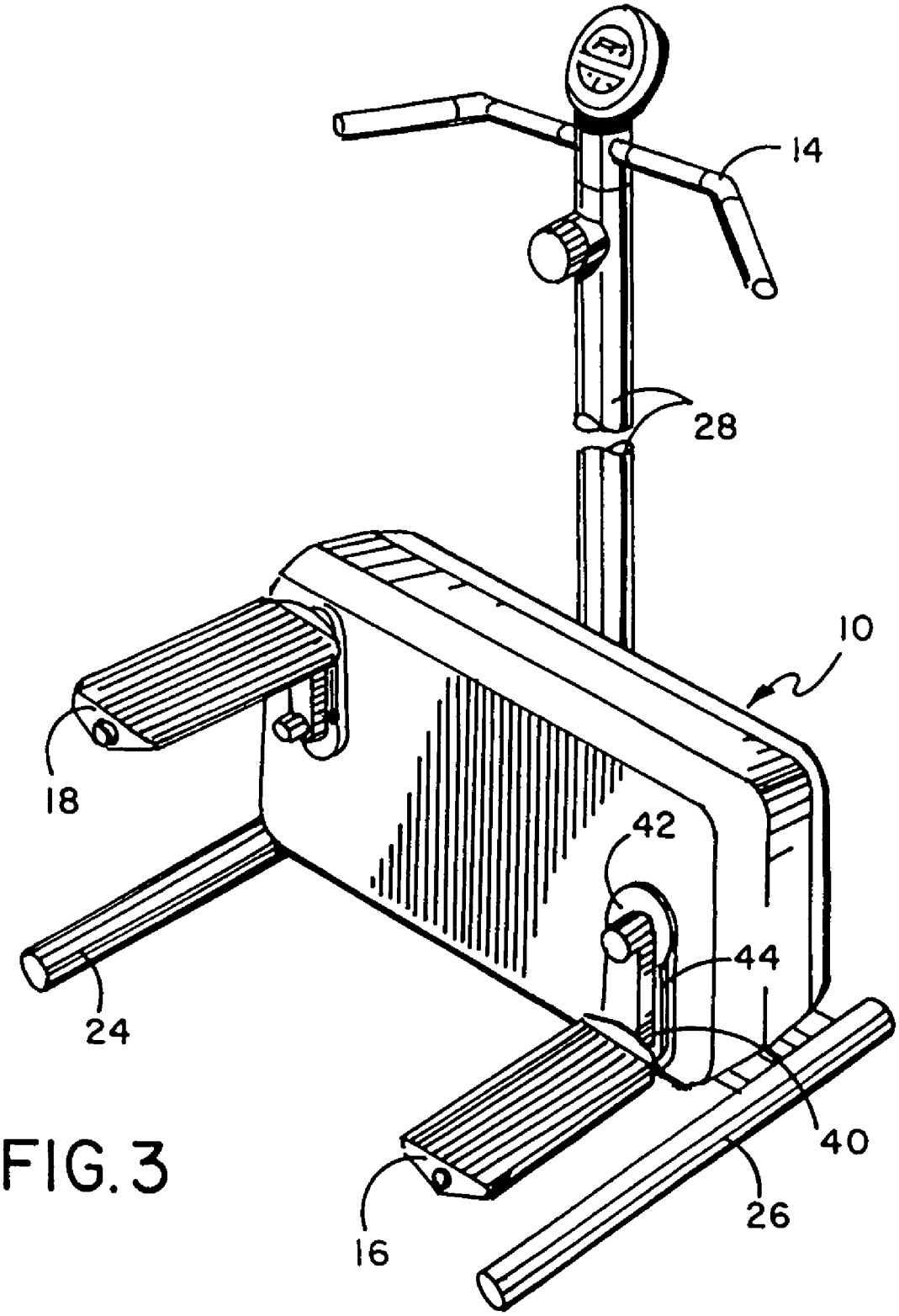
FIG. 3 illustrates a front perspective view of the device of this invention.

FIG. 3 illustrates a perspective view of device 10 of this invention showing handle support member 28 which can be adjustable in height. A laterally disposed handle 14 can be provided for the user to hold while using device 10. Second pedal 16 is seen in its downward position at approximately a 6 o'clock position, and first pedal 18 is seen in its upward position at approximately a 12 o'clock position. In a preferred embodiment the user operates each pedal in an outward direction of movement, and the pedals move laterally in synchronized opposition to one another. The position of first pedal 18 is 180 degrees from the position of second pedal 16, as seen in circular diagram 19 of FIG. 2, showing the plane of rotation defined by the rotation of each pedal as it moves through its circular motion. The upper face of each pedal always faces upwards so that the user's foot will maintain good contact with the pedal, as will be described further below.

Figure 4:
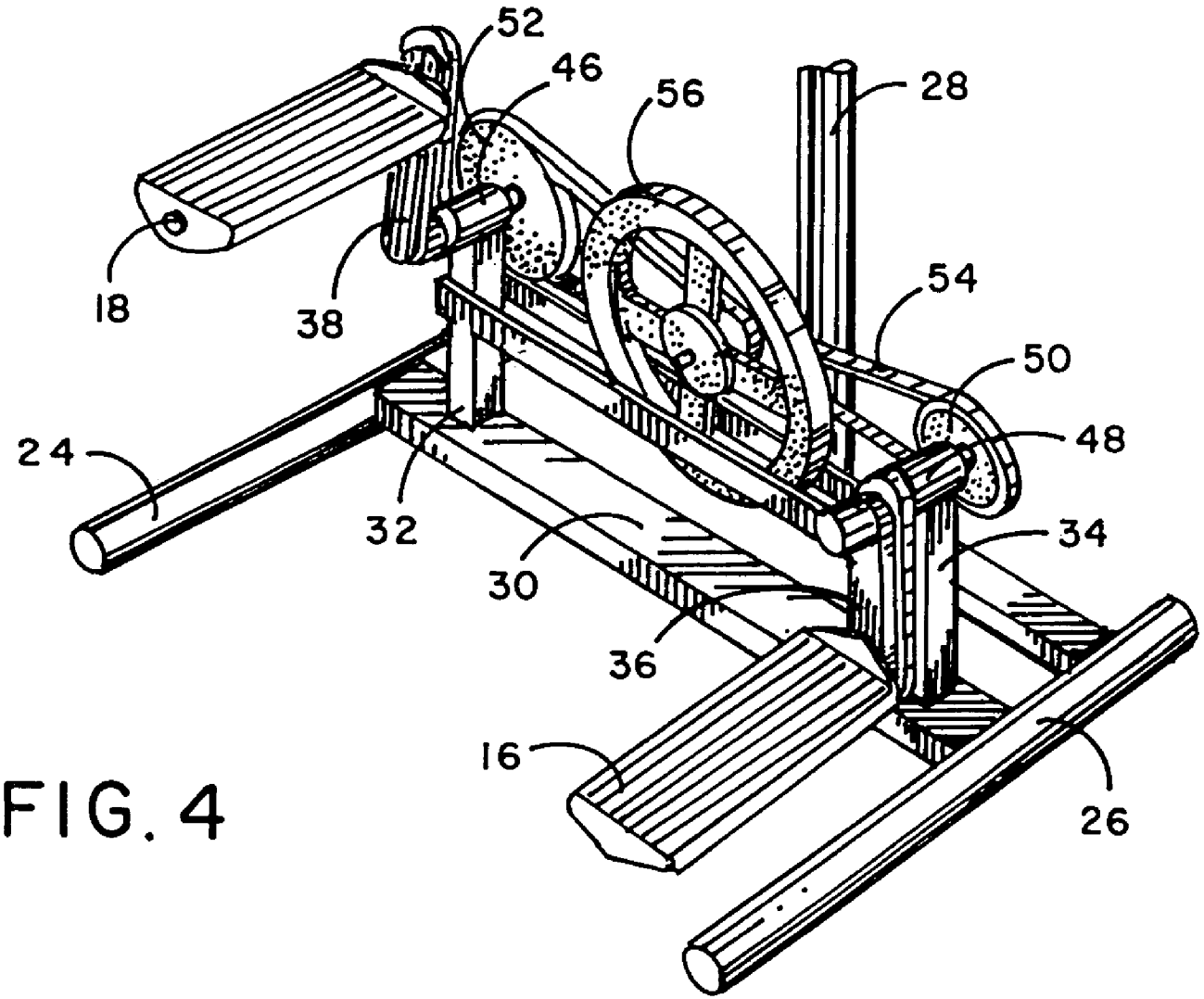
FIG. 4 illustrates a front perspective view of the device of this invention with the housing removed therefrom.

The internal operating mechanism, as seen in FIG. 4, provides for a second pedal support member 36 for second pedal 16, and a first pedal support member 38 for first pedal 18. First and second pedal support members 38 and 36 extend, respectively, to the second ends of first axle member 46 and second axle member 48 which axle members are rotatably supported, respectively, on first shaft support member 32 and second shaft support member 34. First and second axle members 46 and 48 are horizontally disposed apart from one another parallel to floor 78 and 90 degrees to the vertical dorsal-ventral plane 70 of the user, and their planes of rotation are parallel to the plane of bilateral axis 72 of user 12. First and second axle members 46 and 48 are spaced apart from one another a distance of approximately 2–3 ft which can be reached by the user's feet. First and second shaft support member 32 and 34 can be supported on central cross member 30.

Figure 5:
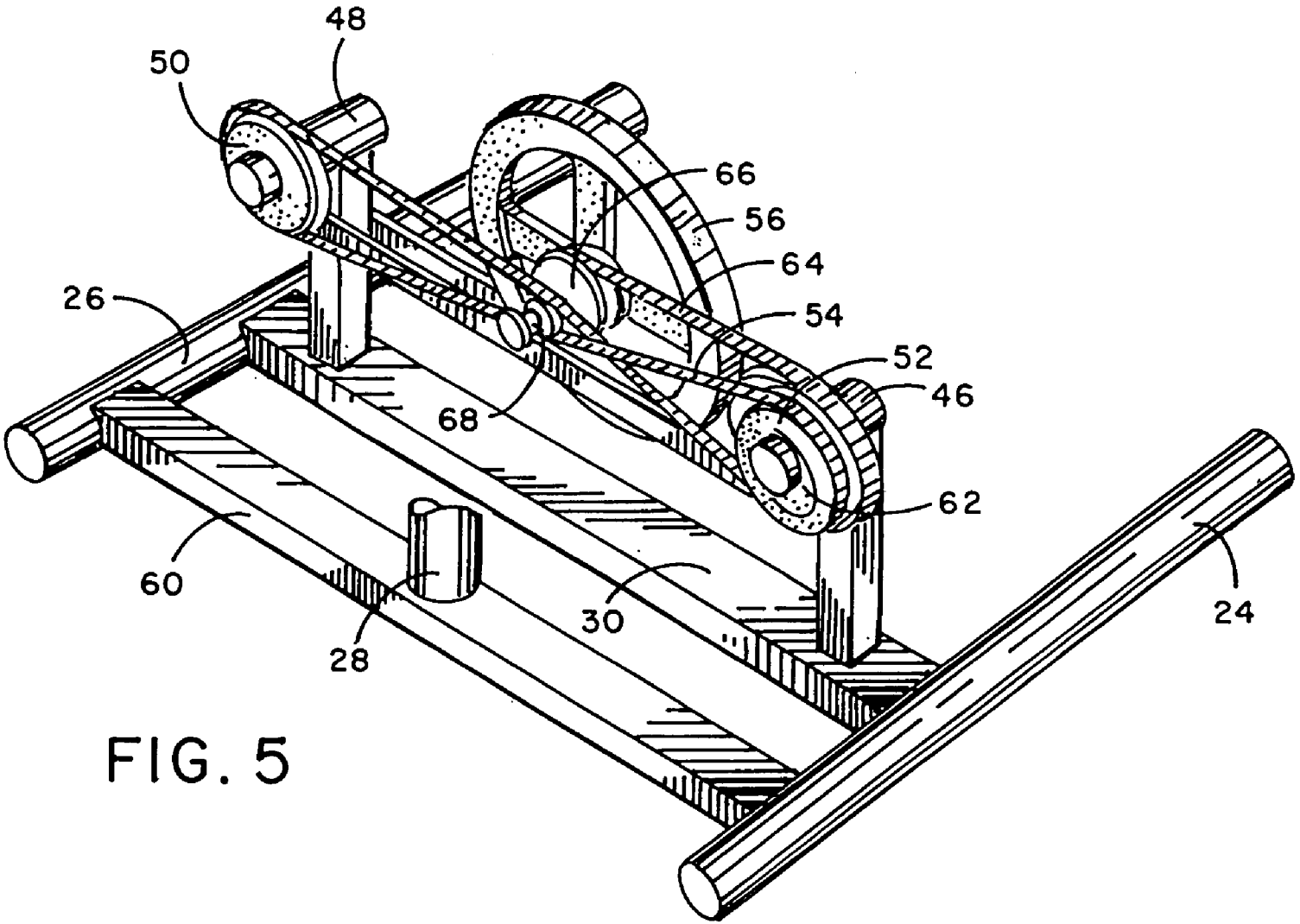
FIG. 5 illustrates a rear perspective view of the operating mechanism with the handle support shaft cut away for ease in viewing the operating mechanism.

As seen in FIG. 5 handle support cross member 60 can support handle support member 28 which is shown cut away in order to provide a better rear view of the device's operating mechanism. Each axle member at its first end is attached to a pulley member such that first axle member 46 is attached to first pulley member 62, and likewise second axle member 48 is attached to second pulley member 50. Drive belt 54 is attached in a figure 8 pattern around first and second pulley members 62 and 50, as will be described further below. The operating mechanism, as seen in FIG. 5, shows that the front of first pulley member 62 includes first flywheel pulley 52. Drive belt 54 extends around first pulley 62 and extends and crosses itself on the sides of spindle 68 which is attached to flywheel 56. A second belt, being flywheel belt 64, extends from first flywheel pulley 52 to second flywheel pulley 66 positioned on spindle 68, which flywheel belt 64 drives fly wheel 56 such that as the pedals are rotated, they move in concert with one another due to their interconnection by drive belt 54, and they also drive fly wheel 56 by the interconnection thereto with flywheel belt 64, thereby providing a smooth pedaling action. A housing 58, as seen in FIG. 3, covers and protects the operating mechanism.

Figure 6:
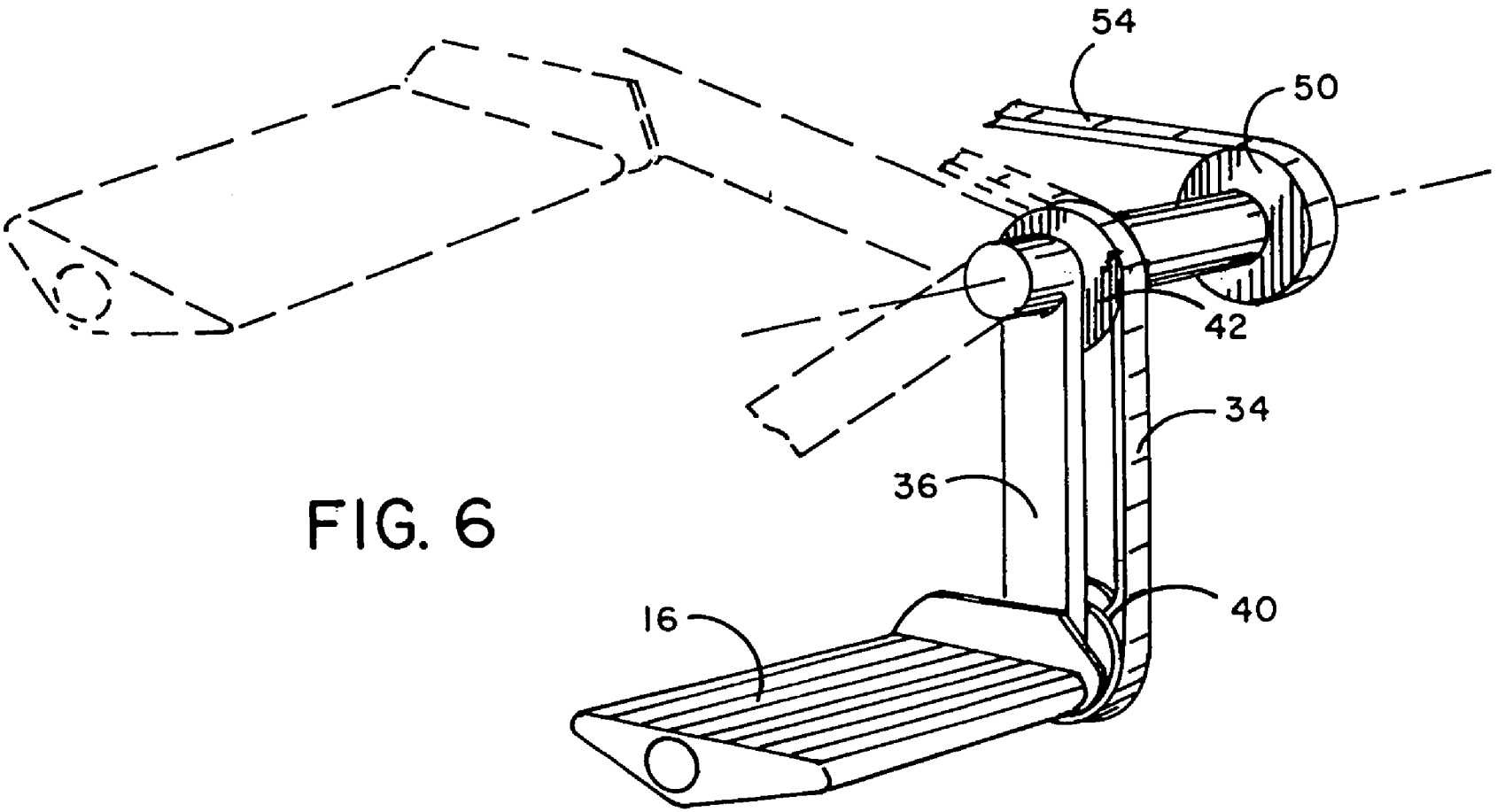
FIG. 6 illustrates a close-up view of the pedal mechanism for maintaining the pedals in an upward facing position.

The pedals' foot-contacting upper surfaces always face upward due to the operating mechanism. Although second pedal 16 is illustrated and its operation described herein, such illustration and description also applies to first pedal 18. FIG. 6 illustrates a close-up view of the pedal mechanism, showing second pedal 16 attached by second pedal support member 36 to second axle member 48. Second pedal 16 is attached to the second pedal support member 36 in a rotatable fashion with a rotatable pedal pulley 40 disposed at the rear of second pedal 16, which pedal pulley 40 is attached by pedal pulley belt 44 to fixed pulley 42 at the second end of second axle member 48. Fixed pulley 42 does not rotate as it engages pedal pulley belt 44 so that as the second pedal rotates in a lateral action, as seen in the dashed lines in FIG. 6, pedal pulley belt 44 with a portion around fixed pulley 42 always keeps upper surface 74 of second pedal 16 in an upright position as it rotates around second axle member 48.

Tension controls and electronics can be attached to this device so that the user can control the pedals' resistance to movement and monitor other factors such as time, calories expended, etc. as desired by the user. Other equivalent mechanisms can be used for producing the pedal movement of the device of this invention.

Although the present invention has been described with reference to particular embodiments, it will be apparent to those skilled in the art that variations and modifications can be substituted therefor without departing from the principles and spirit of the invention.

I claim:

1. An exercise device for use by a user, said user having a dorsal-ventral axis plane, a bilateral axis plane disposed at 90 degrees to said dorsal-ventral axis plane, and first and second legs, each leg having a foot, comprising:

first and second axles, each having an axis, and each having a first and second end;

first and second pedal support members, each having first and second ends, said second ends of said first and second pedal support member mounted, respectively, on said second ends of said first and second axle members;

first and second pedal members, each having front and rear ends and an upper surface, said rear ends of said first and second pedal members attached, respectively, to said first ends of said first and second pedal support members, said first and second pedal members for rotating, 360 degrees respectively, around said axes of said first and second pedal axles, during exercise use defining planes of rotation of said first and second pedal members; and said planes of rotation of each of said first and second pedal members parallel to one another, said planes of rotation being in the same vertical plane, said vertical plane being parallel to said bilateral axis plane of said user, said first and second pedal members each adapted for receiving one of said user's feet when said user is positioned on said device such that said user's bilateral axis plane is parallel to said vertical plane of rotation of said first and second pedal members.

2. The exercise device of claim 1 further including means for synchronizing the rotation of said first and second pedal members to one another.

3. The exercise device of claim 2 wherein said synchronization means disposes the positioning of said first and second pedal members at 180 degrees from one another in rotation.

4. The exercise device of claim 3 further including:

first and second shaft support members, each having first and second ends, said first ends of said first and second shaft support members extending, respectively, to said first ends of said first and second axles;

a central cross member, said second ends of said first and second shaft support members attached to said central cross member;

a handle support cross member;

a handle support member having first and second ends, said first end attached to said handle support cross member, said handle support member extending upward from said handle support cross member; and a handle member, said handle member attached to said second end of said handle support member, said handle member disposed for said user to hold while exercising on said exercise device.

5. The exercise device of claim 4 further including means for maintaining said upper surfaces of said first and second pedal members in an upward-facing position.

6. The exercise device of claim 5 further including:

first and second pulleys each mounted, respectively, on said second ends of said first and second axles; and a drive belt interconnecting said first and second pulleys.

7. The exercise device of claim 6 further including:

a first flywheel pulley attached to said first pulley;

a flywheel; and a flywheel drive belt interconnecting said first flywheel pulley to said flywheel for driving said flywheel.

* * * * *